US006922544B2

(12) United States Patent
Ide

(10) Patent No.: US 6,922,544 B2
(45) Date of Patent: Jul. 26, 2005

(54) IMAGE-FORMING SYSTEM

(75) Inventor: Osamu Ide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 25 days.

(21) Appl. No.: 10/382,626

(22) Filed: Mar. 7, 2003

(65) Prior Publication Data

US 2003/0231912 A1 Dec. 18, 2003

(30) Foreign Application Priority Data

Jun. 14, 2002 (JP) ..... P.2002-174737

(51) Int. Cl.[7] ..... G03G 15/00
(52) U.S. Cl. ..... 399/390; 399/400
(58) Field of Search ..... 399/390, 400

(56) References Cited

U.S. PATENT DOCUMENTS 4,431,302 A * 2/1984 Weber ..... 399/50
5,953,566 A * 9/1999 Fujiwara et al. ..... 399/223
6,049,680 A * 4/2000 Goris et al. ..... 399/44
2002/0037176 A1 * 3/2002 Ogino et al. ..... 399/68

FOREIGN PATENT DOCUMENTS

JP 5-197184 8/1993

* cited by examiner

*Primary Examiner*—Ren Yan
(74) *Attorney, Agent, or Firm*—Morgan, Lewis & Bockius LLP

(57) ABSTRACT

An image-forming system such as a copying machine or a printer with electrophotography. The image-forming system includes an image-creating unit, a fixing unit, a medium conveyance path, and a surface modification unit. The image-creating unit has an image-forming region and forms an image on a medium. The fixing unit fixes the image formed by the image-creating unit on the medium. The medium conveyance path extends to the image-forming region. The surface modification unit is placed along the medium conveyance path. The surface modification unit activates a surface of the medium.

19 Claims, 10 Drawing Sheets

FIG. 9

| | SURFACE RESISTANCE | | SURFACE RESISTANCE REDUCTION RATIO | CONTACT ANGLE | | SUPERFICIAL OXYGEN RATIO (%) |
|---|---|---|---|---|---|---|
| | BEFORE TREATMENT (Ω) | AFTER TREATMENT (Ω) | | BEFORE TREATMENT | AFTER TREATMENT | |
| EXAMPLE 1 | $10^{15}$ | $5 \times 10^{11}$ | $2 \times 10^{3}$ | 80° | 50° | - |
| EXAMPLE 2 | $10^{15}$ | $5 \times 10^{11}$ | $2 \times 10^{3}$ | 80° | 50° | - |
| EXAMPLE 3 | $5 \times 10^{13}$ | $5 \times 10^{9}$ | $10^{4}$ | 90° | 60° | 18% |
| EXAMPLE 4 | $10^{15}$ | $5 \times 10^{11}$ | $2 \times 10^{3}$ | 80° | 50° | - |
| EXAMPLE 5 | $5 \times 10^{13}$ | $5 \times 10^{9}$ | $10^{4}$ | 90° | 60° | 18% |
| EXAMPLE 6 | $10^{15}$ | $5 \times 10^{10}$ | $2 \times 10^{4}$ | 80° | 40° | - |
| EXAMPLE 7 | $5 \times 10^{13}$ | $10^{9}$ | $5 \times 10^{4}$ | 90° | 55° | 20% |

FIG. 10

| | GRAININESS | MOTTLE | TOTAL IMAGE QUALITY | TRANSFER EFFICIENCY (INITIAL STAGE) | TRANSFER EFFICIENCY (AFTER MAKING 1,000 COPIES) | FIXATION |
|---|---|---|---|---|---|---|
| EXAMPLE 1 | ○ | ○ | ○ | ○ | △ | ○ |
| EXAMPLE 2 | ○ | ○ | ○ | ○ | △ | ○ |
| EXAMPLE 3 | ○ | △ | ○ | △ | △ | ○ |
| EXAMPLE 4 | △ | △ | △ | ○ | △ | ○ |
| EXAMPLE 5 | △ | ○ | △ | ○ | ○ | ○ |
| EXAMPLE 6 | ○ | ○ | ○ | ○ | △ | ○ |
| EXAMPLE 7 | ○ | ○ | ○ | ○ | ○ | ○ |
| COMPARATIVE EXAMPLE 1 | △ | × | × | △ | × | ○ |
| COMPARATIVE EXAMPLE 2 | △ | △ | △ | △ | × | ○ |
| COMPARATIVE EXAMPLE 3 | △ | △ | × | △ | × | × |

IMAGE-FORMING SYSTEM

BACKGROUND OF THE INVENTION

1. Field of the Invention

The present invention relates to improvement in an image-forming system with electrophotography or the like.

2. Background Art

In a color image-forming system with electrophotography, the following image-creating process has been heretofore used for making a color copy.

That is, an original is illuminated with light. The reflected light from the original is color-separated by a color scanner, and image-processed and color-corrected by an image processing unit to obtain color image signals corresponding to each primary colors. The color image signals classified by colors are modulated for laser beams, for example semiconductor laser beams. An image carrier made of an inorganic photoconductor such as Se or amorphous silicon, or made of an organic photoconductor using a phthalocyanine pigment, a bisazo pigment or the like as a charge-generating layer is irradiated with the laser beams color by color, by a plurality of times to thereby form a plurality of electrostatic latent images. The plurality of electrostatic latent images are developed, for example, with four charged color toners of Y (yellow), M (magenta), C (cyan) and K (black) in order. Then, the developed toner images are transferred from the image carrier of the inorganic or organic photoconductor onto a medium (transfer medium) such as a sheet of paper and fixed by a fixing unit, for example, of a heating and pressurizing fixation type. In this manner, a color image is formed on the medium.

In this case, each of the color toners is composed of: binder resins such as a polyester resin, a styrene/acrylic copolymer or a styrene/butadiene copolymer; colorants; and fine particles such as inorganic fine particles of silicon oxide, titanium oxide, aluminum oxide or the like or resin fine particles of PMMA, PVDF or the like having a mean particle size of 5 nm to 100 nm; and has a mean particle size of 1 $\mu$m to 15 $\mu$m.

Examples of the colorant used as Y (yellow) are benzidine yellow, quinoline yellow, and Hansa yellow. Examples of the colorant used as M (magenta) are rhodamine B, rose bengal, and pigment red. Examples of the colorant used as C (cyan) are phthalocyanine blue, aniline blue, and pigment blue. Examples of the colorant used as K (black) include carbon black, aniline black, and blend of color pigments.

In the transfer process, for example, there is known a method in which a transfer roll or transfer belt made of a dielectric or the like is disposed opposite to the image carrier of the photoconductor in advance, and a bias voltage applied to the transfer roll electrostatically transfer the toner images onto the medium placed on the transfer roll or on a predetermined transfer belt disposed on the back of the transfer roll.

In the transfer process, for example, there is also known a method in which an intermediate transfer medium made of a dielectric and, for example, shaped like a belt is disposed opposite to the image carrier of the photoconductor so that electric field is applied from the back of the intermediate transfer medium by use of a predetermined primary transfer member (e.g., a transfer corotron, a bias voltage-applied transfer roll, or a bias voltage-applied transfer brush) to thereby transfer the toner images formed on the image carrier onto the intermediate transfer medium color by color to form a color toner image on the intermediate transfer medium once, and then electric field is given from the back of the medium by use of a predetermined secondary transfer member (e.g., a transfer corotron, a bias voltage-applied transfer roll, or a bias voltage-applied transfer brush) to thereby electrostatically transfer the color toner image onto the medium.

SUMMARY OF THE INVENTION

In this type of image-forming system, so-called coated paper having electrically insulating resin layers on its surfaces may be used as the medium in order to obtain a high-quality image. In this type of medium, there is however a possibility that granularity may be spoiled or surface uniformity of the image may be worsened due to a considerably large amount of untransferred toner. Hence, there is a technical problem that a good image cannot be always obtained.

As measures to solve the technical problem, there is used a method of increasing the bias voltage applied to the transfer roll, the transfer corotron, the transfer brush or the like, or a method of reducing both the conveyance speed of the medium and the speed of the image carrier at the transfer time.

When this type of method is to be used, the system is however large-sized, for example, in order to increase the bias voltage. Hence, there is a problem that deterioration of the image carrier of the photoconductor, the transfer belt, etc. is hastened unnecessarily. On the other hand, if the conveyance speed of the medium at the transfer time is set to be slow, there is a problem that the time required for forming an image becomes excessive because of the slow conveyance speed.

For this reason, there is self-limitation on the method of setting the bias voltage to be high or setting the conveyance speed of the medium to be slow. In the related-art method, it is very difficult to form an image satisfying all conditions of sufficient stability of image density, stability of color characteristic, reduction in amount of remaining untransferred toner enough to keep surface uniformity, and low granularity.

Particularly when the basis weight of the medium is heavy, it is necessary to increase the bias voltage more greatly, so that the image defect has a tendency to be worsened.

Moreover, when the uppermost layer of the medium is a layer containing a resin such as polyethylene, polypropylene or polyethylene terephthalate as a main component, there is a technical problem that the adhesion of the resin to each color toner is poor.

Incidentally, in order to improve the image defect caused by electrostatic transfer and the problem of adhesion of each color toner resin to the medium when the uppermost layer of the medium is a layer containing a resin such as polyethylene, polypropylene or polyethylene terephthalate as a main component, a proposal to further provide a layer of low resistance on the uppermost layer to improve the adhesion has been already made as the related art described in Japanese Patent Laid-Open No. 197184/1993.

The special medium is however undesirable because it is expensive.

The invention is provided to solve the technical problems and an object of the invention is to provide an image-forming system in which an image (mainly a color image) having no image defect can be surely formed on a medium even in the case where the medium used is a general-purpose inexpensive medium.

That is, as shown in FIG. 1, the invention provides an image-forming system including an image-creating unit 2 for forming an image G on a medium 1, and a fixing unit 3 for fixing the image G formed by the image-creating unit 2 on the medium 1, wherein the image-forming system further includes a surface modification unit 5 placed along a medium conveyance path 4 extending to an image-forming region of the image-creating unit 2 for activating a surface of the medium 1.

In this technical means, the medium 1 may be selected suitably if an image can be fixed on the medium 1. This technical means is effective in the case where the technical problems appear in the medium 1, that is, specifically, in the case where a surface of the medium 1 includes a layer which contains an electrically insulating thermoplastic resin as a main component.

The image G is not limited to a color image but may be a monochromatic image. A subject of this technical means is however mainly a color image.

For example, in electrophotography (or an electrostatic recording method), there is a tendency that it is difficult to obtain a color toner image having excellent transfer ability and a sufficient adhesion strength between the toner layer and the medium. Hence, the invention is effective in the case where the image includes color toner images or by a combination of color toner images and a transparent toner image.

The concept "image-creating unit 2" widely includes a for forming an image on the medium 1. For example, in electrophotography (or an electrostatic recording method), the image-creating unit 2 may include an electrostatic transfer unit 2*a* for electrostatically transferring the created image G onto the medium 1.

The fixing unit 3 may be selected suitably if the image G created by the image-creating unit 2 can be fixed on the medium 1 by the fixing unit 3. From the point of view of keeping fixation better, for example, in a mode in which color toner images are fixed, the fixing unit 3 may include a fixing member 3*a* which comes into close contact with the toner images (image G) on the medium 1 so that the toner images are sandwiched between the fixing member 3*a* and the medium 1, a heating and pressurizing unit 3*b* for heating and pressurizing the toner images on the medium 1, and a cooling and releasing unit 3*c* for cooling the heated and pressurized toner images and releasing them from the fixing member 3*a*.

In this mode, if the surface characteristic of the fixing member 3*a* is smooth, a high-gross image can be obtained because the surface characteristic of the fixing member 3*a* is directly transferred to the image surface when cooling and releasing is performed after heating and pressurizing fixation.

The surface modification unit 5 may be selected suitably if the surface of the medium 1 can be activated by the surface modification unit 5. For example, a corona discharge treatment unit, an ultraviolet irradiation treatment unit, or a plasma treatment unit may be selected as the surface modification unit 5. Particularly, a corona discharge treatment unit is preferably used from the point of view of size and treatment time.

When the surface of the medium 1 on the medium conveyance path 4 is modified by the surface modification unit 5, the surface of the medium 1 is activated. As a result, for example, the surface resistance of the medium 1 modified by the surface modification unit 5 is reduced by a predetermined level. Hence, an operation of transferring the image G onto the medium 1 and an operation of fixing the image G on the medium 1 can be easily performed correspondingly to the reduction of the surface resistance.

Incidentally, preferred embodiments of the invention will be described in detail in the following mode for carrying out the invention.

BRIEF DESCRIPTION OF THE DRAWINGS

The present invention may be more readily described with reference to the accompanying drawings;

FIG. 9 is an explanatory view showing surface characteristics before and after surface modification in Examples 1 to 7.

FIG. 10 is an explanatory view showing results of evaluation in Examples 1 to 7 and Comparative Examples 1 to 3.

DETAILED DESCRIPTION OF THE PREFERRED EMBODIMENTS

The invention will be described below in detail on the basis of embodiments shown in the accompanying drawings.

Embodiment 1

Figure 1:
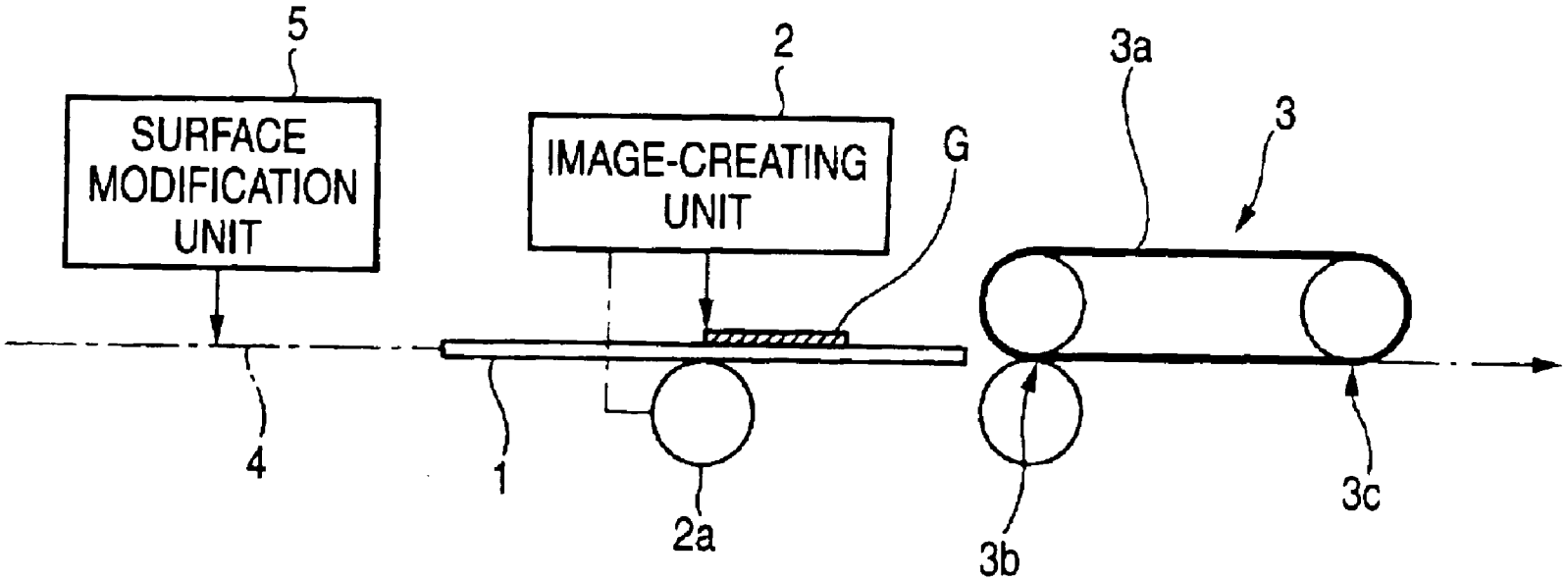
FIG. 1 is an explanatory view showing an outline of an image-forming system according to the invention.
Figure 2:
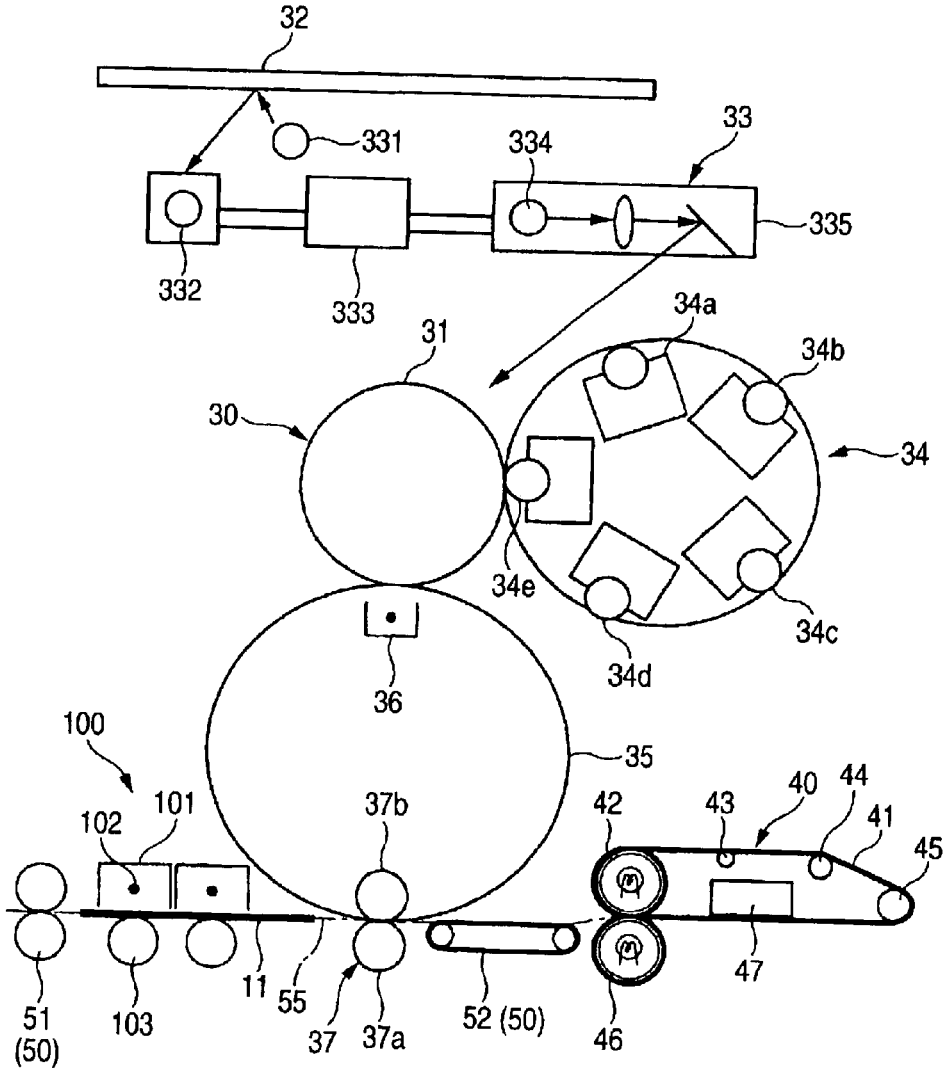
FIG. 2 is an explanatory view showing Embodiment 1 of the image-forming system according to the invention.

FIG. 2 shows Embodiment 1 of a color image-forming system according to the invention.

In FIG. 2, the color image-forming system according to this embodiment has an image-creating unit 30 for forming a color image on a medium 11, a fixing unit 40 for fixing respective toner images formed by the image-creating unit 30 on the medium 11, a conveyor unit 50 for conveying the medium 11 to an image transfer region of the image-creating unit 30 and to the fixing unit 40, and a surface modification unit 100 placed along the upstream side of the image transfer region of the image-creating unit 30 in a medium conveyance path 55 in which the medium 11 is conveyed.

Figure 3A:
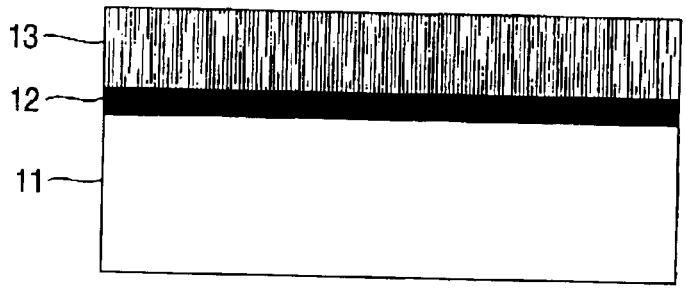
FIG. 3A is an explanatory view showing an example of an image structure obtained in Embodiment 1.

In this embodiment, for example, as shown in FIG. 3A, the created image is structured so that a layer of color toners 12 and a transparent toner layer 13 are superimposed on the medium 11 at least having a surface which includes a layer containing an electrically insulating thermoplastic resin as a main component.

A known medium can be used as the medium 11 if the medium has a surface layer containing an electrically insulating thermoplastic resin as a main component. For example, the thickness of the medium 11 is preferably selected to be in a range of from 100 μm to 250 μm, both inclusively.

Figure 3B:
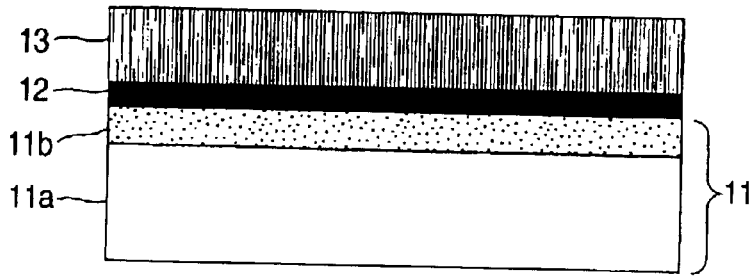
FIGS. 3B and 3C are explanatory views showing other examples of the image structure obtained in Embodiment 1.

For example, a medium as shown in FIG. 3B is preferably used as the medium 11. That is, a medium at least having a raw paper layer (e.g., 130 g/m$^2$ or higher in terms of basis weight) 11*a* made of a pulp material, and a diffuse reflection layer 11*b* laminated on the raw paper layer 11*a* and made of a thermoplastic resin (e.g., a polyethylene resin) containing a white pigment (e.g., titanium oxide particles) dispersed therein is preferably used as the medium 11.

As the white pigment, there can be used a known white pigment such as titanium oxide, silica, alumina, calcium carbonate, or kaoline. Although a plurality of white pigments may be used in combination, titanium oxide is preferably used from the point of view of whiteness.

On the other hand, a known resin such as polyethylene, polypropylene, or polyester may be used as the thermoplastic resin. Particularly, a polyolefin (such as polyethylene or polypropylene) resin is preferably used from the point of view of cost and fixation.

The medium 11 provided as described above is high in whiteness and has smooth and high glossy surfaces. Even in the case where an image is formed on the rear surface of the medium 11, the image is invisible from the front surface. Hence an image formed on the front surface can be provided with a good color saturation and low graininess.

As the medium 11, there is preferably used a medium which at least has a raw paper layer 11*a* made of a pulp material, and a diffuse reflection layer 11*b* laminated on the raw paper layer 11*a* and made of a polyethylene resin as a thermoplastic resin containing titanium oxide particles dispersed therein as a white pigment as shown in FIG. 3B and which further has a gelatin layer (not shown) coated on the diffuse reflection layer 11*b*.

The medium 11 provided as described above is high in whiteness and has smooth and highly glossy surfaces. Even in the case where an image is formed on the rear surface of the medium 11, the image is invisible from the front surface. Hence an image formed on the front surface can be provided with a good color saturation and low graininess. The medium 11 is particularly preferable in terms of improvement of transfer characteristic due to the presence of the gelatin layer.

As the medium 11, there is preferably used a medium which has a raw paper layer 11*a* made of a pulp material, and which at least has a diffuse reflection layer 11*b* laminated on the raw paper layer 11*a* and made of a polyethylene resin as a thermoplastic resin containing titanium oxide particles dispersed therein as a white pigment as shown in FIG. 3B and which further has a polyethylene resin layer (not shown) and an antistatic layer (not shown) on the rear surface side.

The medium 11 provided as described above is high in whiteness and has smooth and high glossy surfaces. Even in the case where an image is formed on the rear surface of the medium 11, the image is invisible from the front surface. Hence an image formed on the front surface can be provided with a good color saturation and low graininess. In addition, the medium 11 has an advantage that dust or dirt is hardly deposited on the medium 11 as well as conveyance characteristic of the medium 11 is good.

Figure 3C:
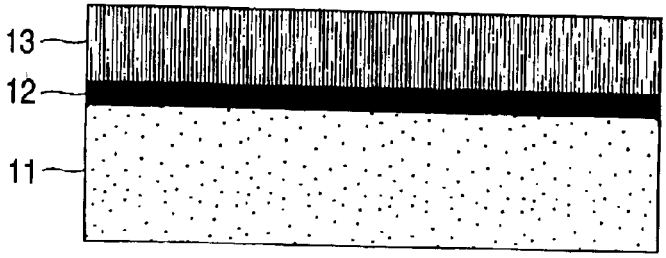

As the medium 11, there may be also used a medium having a diffuse reflection layer made of a polyethylene terephthalate (PET) resin containing a white pigment dispersed therein as shown in FIG. 3C.

Also the medium 11 provided thus is high in whiteness and has smooth and highly glossy surfaces. Even in the case where an image is formed on the rear surface of the medium 11, the image is invisible from the front surface. Hence an image formed on the front surface can be provided with a good color saturation and low graininess.

It is also preferable that a fluorescent whitening agent is mixed with the diffuse reflection layer.

For example, the color toner image 12 is made of a layer which is formed in such a manner that known electrophotographic color toner particles of a thermoplastic resin containing colorants dispersed therein are melted and fixed.

The composition, mean particle size, etc. of the color toner can be selected suitable so as not to impede the object of the invention.

Polyester is preferably used as the thermoplastic resin from the point of view of adhesion and low-temperature fixation of the toner particles to the medium 11. It is also preferable from the point of view of charging characteristic and fluidity that inorganic fine particles such as silica particles or titanium oxide particles are deposited on the toner particles. It is further preferable from the point of view of smooth tone reproduction, resolution, granularity, etc. that the volume-average particle size is in a range of from 3 μm to 10 μm. Although the particle size of the color toner need not be limited particularly, it is further preferable that the particle size is in a range of from 4 μm to 8 μm, both inclusively, in consideration of the provision of the function by which an electrostatic latent image due to an exposure unit which will be described later can be reproduced faithfully.

Although electrically insulating particles at least containing binder resins and colorants may be suitably selected as the color toner, three kinds of toners, that is, cyan, magenta and yellow toners can be preferably used. In addition to the three kinds of toners, a black toner may be used.

As the binder resin, there is used binder resins the same as will be described later as binder resins in a transparent toner. The binder resin may be preferably polyester with weight-average molecular weight of from 5,000 to 12,000.

The colorant is not particularly limited if it is a colorant usually used for toner. The colorant can be selected from a cyan pigment or dye, a magenta pigment or dye, a yellow pigment or dye and a black pigment or dye which are known in themselves.

Preferably, it is important to suppress light scattering at the boundary between the pigment of the colorant and the binder resin in order to enhance the effect of obtaining high gloss. For example, combination of the binder and a colorant containing a pigment of a small particle size highly dispersed as described in Japanese Patent Laid-Open No. 242752/1992 is effective in suppressing the light scattering.

In this embodiment, the color toners may be produced suitably or may be products available on the market.

Incidentally, each of the color toners is used after it is mixed with a carrier selected suitably and known in itself to form a developer. As a one-component developer, there may be also used means for developing a charged toner formed by charging due to friction with a development sleeve or a charging member, in accordance with an electrostatic latent image.

The transparent toner image 13 is constituted by a layer of transparent toner particles melted and fixed.

The transparent toner at least contains a thermoplastic binder resin.

In this embodiment, the concept "transparent toner" means a toner having toner particles containing no coloring material (e.g., coloring pigment, coloring dye, black carbon particles, black magnetic powder, etc.) intended to perform coloring due to light absorption or light scattering.

Generally, the transparent toner used in this embodiment is colorless and transparent. The transparency of the transparent toner, however, may become slightly low in accordance with the kind and quantity of a fluidizing agent or a release agent contained in the transparent toner. That is, any transparent toner can be used if it is substantially colorless and transparent.

Any resin can be selected suitably as the binder resin in accordance with the purpose if it is substantially transparent. For example, one of known resins generally used for toner or a copolymer of such known resins can be used as the binder resin. Examples of the known resins include a polyester resin, a polystyrene resin, a polyacrylic resin, any other vinyl resin, a polycarbonate resin, a polyamide resin, a polyimide resin, a nepoxyresin, and a polyurearesin. Particularly, a polyester resin is preferably used because it can satisfy toner characteristics such as adhesion to the medium 11, low-temperature fixation, fixing strength, and conservation simultaneously. Preferably, the binder resin has weight-average molecular weight of from 5,000 to 40,000, both inclusively, and a glass transition point of from 55° C., inclusively, to 75° C., not inclusively.

It is necessary to control both fluidity and charging characteristic of the transparent toner in order to obtain uniformly high gloss. From the point of view of controlling both fluidity and charging characteristic of the transparent toner, it is preferable that inorganic fine particles and/or resin fine particles are externally added to or deposited on toner particle surfaces of the transparent toner.

The inorganic fine particles are not particularly limited if they do not impede the effect of the invention. The inorganic fine particles can be selected suitably from known fine particles used as external additives, in accordance with the purpose. Examples of the material of the inorganic fine particles include silica, titanium dioxide, tin oxide, and molybdenum oxide. If stability of charging characteristic or the like is considered, these inorganic fine particles treated with a silane coupling agent or a titanium coupling agent to be made hydrophobic can be also used.

The organic fine particles are not particularly limited if they do not impede the effect of the invention. The organic fine particles can be selected suitably from known fine particles used as external additives, in accordance with the purpose. Examples of the material of the organic fine particles include a polyester resin, a polystyrene resin, a polyacrylic resin, a vinyl resin, a polycarbonate resin, a polyamide resin, a polyimide resin, an epoxy resin, a polyurea resin, and a fluororesin.

Particularly preferably, the inorganic and organic fine particles have a mean particle size of from 0.005 $\mu$m to 1 $\mu$m. If the mean particle size is smaller than 0.005 $\mu$m, there is a possibility that a required effect cannot be obtained because the inorganic fine particles and/or the resin fine particles cohere to one another when they are deposited on particle surfaces of the transparent toner. If the mean particle size is larger than 1 $\mu$m, it is difficult to obtain a higher glossy image.

Preferably, wax is added to the transparent toner.

The composition of the wax is not particularly limited if it does not impede the effect of the invention. The wax can be selected suitably from known materials used as wax, in accordance with the purpose. Examples of the material of the wax include a polyethylene resin and carnauba natural wax. In this embodiment, 2% by weight, inclusively, to 8% by weight, not inclusively, of wax having a melting point of from 80° C. to 110° C., both inclusively, is preferably added to the transparent toner.

The particle size of the transparent toner need not be particularly limited.

From the point of view of forming a thick toner layer without blushing, it is however preferable that the volume-average particle size of the transparent toner is in a range of from 10 $\mu$m to 25 $\mu$m.

Incidentally, the transparent toner is used after it is mixed with a carrier selected suitably and known in itself to form a developer. As a one-component developer, there may be also used means for developing a charged toner formed by charging due to friction with a development sleeve or a charging member, in accordance with an electrostatic latent image.

In this embodiment, a known electrophotographic toner image-forming system is used as the image-creating unit 30.

The fixing unit 40 can be selected suitably. Preferably, the fixing unit 40 has a belt-like fixing member (fixing belt 41), a heating and pressurizing unit for heating and pressurizing an image on the medium 11 through the belt-like fixing member, and a cooling and releasing unit for cooling and releasing the medium 11 after the image is heated and pressurized.

A polymer film such as a polyimide film can be used as the belt-like fixing member. Preferably, the resistance value of the belt-like fixing member is adjusted by dispersing an electrically conductive additive such as electrically conductive carbon particles or an electrically conductive polymer. Although the belt-like fixing member may be shaped like a sheet, the belt-like fixing member may be also preferably shaped like an endless belt. From the point of view of releasability and surface quality, it is preferable that the belt surface of the belt-like fixing member is covered with a silicone resin and/or a fluororesin.

A known unit can be used as the heating and pressurizing unit.

For example, a unit in which the belt-like fixing member and the medium 11 having the image formed thereon are driven while sandwiched between a pair of rolls driven at a constant velocity can be used as the heating and pressurizing unit.

In this embodiment, for example, the heating and pressurizing unit has a pair of rolls one or each of which has a heat source in its inside so that the surface of the roll is heated to a temperature at which the transparent toner can be melted. The two rolls are in pressure contact with each other. Preferably, a silicone or fluoro rubber layer is provided on the surface of one or each of the two rolls, and the length of a heated and pressurized region is in a range of from about 1 mm to about 8 mm.

For example, a unit in which the medium 11 heated and pressurized through the belt-like fixing member is cooled and then released by a release member can be used as the cooling and releasing unit.

Although natural cooling may be used as cooling means in this case, it is preferable from the point of view of size of the unit that a cooling member such as a heat sink or a heat pipe is used for accelerating the speed of cooling. The release member is preferably provided in such a manner that a striping finger is inserted in between the belt-like fixing member and medium 11 or in such a manner that a roll (release roll) small in curvature is provided in the release position for releasing the medium 11.

A conveyor unit known in itself can be used as the conveyor unit 50 for conveying the medium 11 to the image-forming region of the image-creating unit 30 and to the fixing unit 40.

Because it is preferable that the conveyance speed is constant on this occasion, for example, a unit in which the medium 11 is driven while sandwiched between a pair of rubber rolls rotating at a constant rotational speed or a unit in which the medium 11 put on a belt of rubber or the like laid over a pair of rolls one of which is driven at a constant velocity by a motor or the like is driven at a constant velocity can be used as the conveyor unit 50.

Particularly when an unfixed toner image is formed, the latter unit can be preferably used from the point of view of preventing disturbance of the toner image.

In this embodiment, the surface modification unit 100 is placed along the upstream side of the image-forming region of the image-creating unit 30 in the medium conveyance path 55. For example, the surface modification unit 100 has one corona discharge treatment unit or a plurality of corona discharge treatment units (e.g., two corona discharge treatment units in FIG. 2) for use.

Known means can be used as each of the corona discharge treatment units if it has a function for generating a corona discharge current to apply corona discharge treatment to a surface of the medium 11.

Figure 4A:
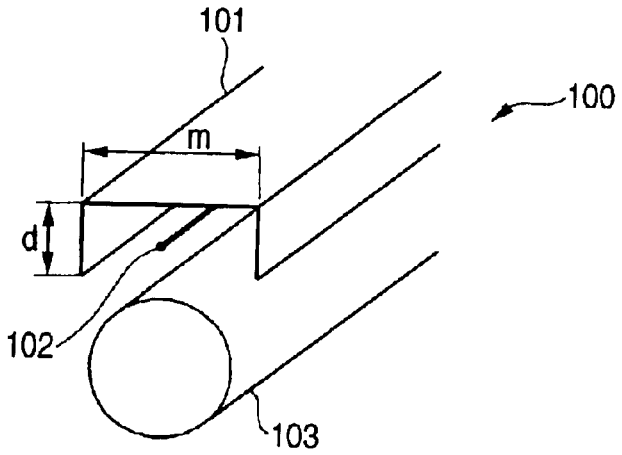
FIG. 4A is an explanatory view showing an outline of a corona discharge treatment unit which is a surface modification unit in Embodiment 1.

For example, as shown in FIGS. 2 and 4A, a corotron charger configured so that a discharge wire 102 such as a tungsten wire supplied with a high voltage by a DC or AC power supply is covered with a metal shield 101 electrically floated or supplied with a bias voltage but the medium 11 side of the discharge wire 102 is opened is used as each of the corona discharge treatment units. Incidentally, the term "floated" means a state of insulation kept through an electrically insulating member from the ground. In this state, there is no corona current flowing from the discharge wire 102.

On the other hand, opposite rolls 103 which rotate following the movement of the medium 11 are disposed in regions opposite to the corotron chargers.

Figure 4B:
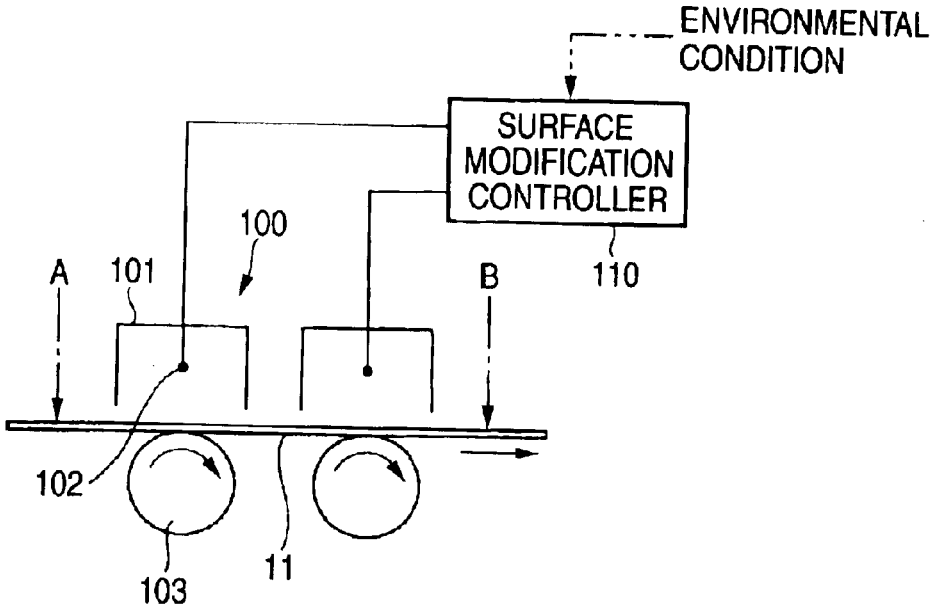
FIG. 4B is an explanatory view showing a control system for the surface modification unit.

As shown in FIG. 4B, a surface modification controller 110 is connected to each of the discharge wires 102 so that the surface modification controller 110 supplies a predetermined discharge voltage to each of the discharge wires 102.

The surface modification controller 110 may be designed so that a predetermined discharge voltage is always applied to each discharge wire 102 when the medium 11 passes through the surface modification unit. Alternatively, the design of the surface modification controller 110 maybe changed suitably so that the applied discharge voltage is controlled to be switched on/off or the level of the applied discharge voltage is changed in accordance with the environmental condition (temperature and humidity).

Incidentally, the corona discharge treatment unit is not limited to the aforementioned form. For example, instead of the corotron charger, there can be used a brush discharger having a metal brush supplied with a high voltage by a DC or AC power supply and having a metal brush tip disposed opposite to the medium 11 by a distance of about 1 mm from the medium 11, a roll discharger having an electrically conductive or semiconductive roll member supplied with a high voltage by a DC or AC power supply and brought into contact with the medium 11 while rotated, or a unit having a knife edge-like electrically conductive member disposed opposite to the medium 11 so as to far by a distance of about 1 mm from the medium 11 and supplied with an AC or DC high voltage.

The image-forming system shown in FIG. 2 will be described below more specifically.

The image-creating unit 30 used in FIG. 2 includes parts disposed around a photoconductor drum 31. That is, the image-creating unit 30 includes a charger not shown, an exposure unit 33 for forming an electrostatic latent image on the photoconductor drum 31 by exposure corresponding to the scanned image data of an original 32, a rotary development unit 34 provided with development units 34*a* to 34*e* having color toner developers of yellow, magenta, cyan and black and a transparent toner developer stored therein respectively, an intermediate transfer belt 35 for temporarily holding an image transferred from the photoconductor drum 31, a cleaning unit not shown but disposed for cleaning toners remaining on the photoconductor drum 31, a primary transfer unit (e.g., transfer corotron) 36 disposed in a region of the intermediate transfer belt 35 opposite to the photoconductor drum 31, and a secondary transfer unit 37 (including a pair of a transfer roll 37*a* and a backup roll 37*b* which are arranged so that the intermediate transfer belt 35 and the medium 11 are clamped between the pair of rolls 37*a* and 37*b* in this embodiment) disposed in a region of the intermediate transfer belt 35 through which the medium 11 passes.

In this embodiment, the exposure unit 33 is provided for irradiating the original 32 with light emitted from an illumination lamp 331, scanning and separating the light reflected from the original 32 into color image data by a color scanner 332, performing image processing by an image processing unit 333, and irradiating exposure points of the photoconductor drum 31 with electrostatic latent image-writing light beams, for example, through an optical system 335 including a laser diode 334.

The fixing unit 40 includes a fixing belt 41 (e.g., made of a belt material having its surface coated with Si rubber) laid over a suitable number of (four in this embodiment) set rolls 42 to 45, a heat roll 42 provided as the set roll located in the inlet side of the fixing belt 41 and capable of being heated, a release roll 45 provided as the set roll located in the outlet side of the fixing belt 41 and capable of releasing the medium 11 from the fixing belt 41, a pressure roll 46 (which may be provided with a heat source in case of necessity) disposed opposite to the heat roll 42 so that the fixing belt 41 is pressed between the heat roll 42 and the pressure roll 46, and a heat sink 47 disposed in the inside enclosed in the fixing belt 41 and provided as a cooling member for cooling the fixing belt 41 in a place between the heat roll 42 and the release roll 45.

The conveyor unit 50 includes a pair of resist rolls 51 disposed on the upstream side of the image-forming region of the image-creating unit 30 in the medium conveyance path 55 so that the medium 11 can be fed while positioned once, and a conveyance belt 52 disposed between the image-forming region of the image-creating unit 30 and the fixing unit 40 in the medium conveyance path 55.

The surface modification unit 100 is further disposed between the resist roll pair 51 and the image-forming region of the image-creating unit 30 in the medium conveyance path 55. For example, in this embodiment, two corona discharge treatment units (using corotron chargers in FIG. 2) are provided as the surface modification unit 100.

Next, the operation of the image-forming system according to this embodiment will be described.

As shown in FIG. 2, when the image-forming system according to this embodiment is to be used for making a color copy, the original 32 as a subject of copying is first irradiated with light emitted from the illumination lamp 331. The light reflected from the original 32 is scanned and separated into color image data by the color scanner 332. The color image data is image-processed and corrected by the image processing unit 333 to thereby obtain a plurality of corrected image data for color toners and corrected image data for a transparent toner. Each corrected image data is modulated by the laser driver (not shown) to thereby generate each modulated laser beam emitted by the laser diode 334.

The photoconductor drum 31 is irradiated with the laser beams color by color by a plurality of times to thereby form a plurality of electrostatic latent images. The plurality of electrostatic latent images are successively developed by the transparent toner development unit 34*e*, the yellow development unit 34*a*, the magenta development unit 34*b*, the cyan development unit 34*c* and the black development unit 34*d* using the transparent toner and the four color toners of yellow, magenta, cyan and black respectively.

The developed color and transparent toner images on the photoconductor drum 31 are successively transferred onto the intermediate transfer belt 35 by the primary transfer unit 36 (transfer corotron). The transparent and four color toner images transferred onto the intermediate transfer belt 35 are collectively transferred onto the medium 11 by the secondary transfer unit 37.

On the other hand, the corona discharge treatment unit 100, which serves as the surface modification unit, applies corona discharge treatment to a surface of the medium 11 to activate the surface of the medium 11.

For example, the condition of the medium 11 requiring the corona discharge treatment (surface modification) in this embodiment is the case where the surface resistance of the medium 11 is not lower than $10^{11}$ Ω or the contact angle for water of the medium 11 is not smaller than 70 degrees before the corona discharge treatment (surface modification).

Accordingly, when the surface resistance or contact angle condition of the medium 11 indicates that the surface modification is not required, the corona discharge treatment by the corona discharge treatment unit 100 may be omitted, or the corona discharge treatment unit 100 may be controlled suitably, for example, in accordance with the environmental condition.

In this manner, when the activated medium 11 reaches the image-forming region of the image-creating unit 30, the respective toner images on the intermediate transfer belt 35 are surely transferred onto the medium 11 with sufficient transfer efficiency.

Figure 5:
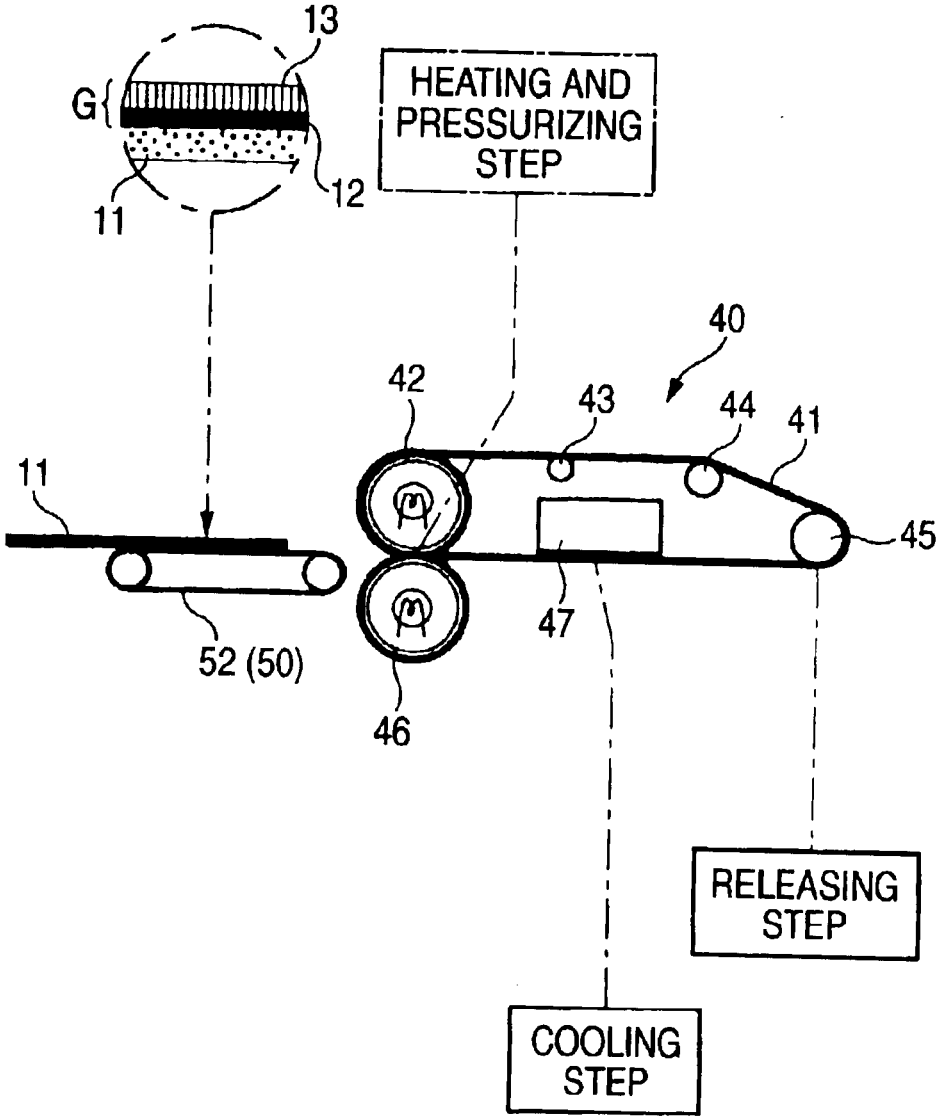
FIG. 5 is an explanatory view showing an image fixing step in Embodiment 1.

Then, as shown in FIG. 5, the medium 11 having the color toner images 12 and the transparent toner image 13 formed thereon is conveyed into the fixing unit 40 via the conveyance belt 52.

Next, the operation of the fixing unit 40 will be described. Both the heat roll 42 and the pressure roll 46 are heated to a toner melting temperature in advance. For example, a load of 100 kg weight is applied between the two rolls 42 and 46. The two rolls 42 and 46 are further driven to rotate, so that the fixing belt 41 is driven following the two rolls 42 and 46.

The fixing belt 41 is brought into contact with the surface of the medium 11, on which the color toner images 12 and the transparent toner image 13 are formed, in a nip portion between the heat roll 42 and the pressure roll 46. As a result, the color toner images 12 and the transparent toner image 13 are heated and melted (heating and pressurizing step).

Then, the medium 11 and the fixing belt 41 are carried to the release roll 45 while the medium 11 and the fixing belt 41 are bonded to each other through the melted toner layer. During the conveyance, the fixing belt 41, the transparent toner image 13, the color toner images 12 and the medium 11 are cooled by the heat sink 47 (cooling step).

Accordingly, when the medium 11 reaches the release roll 45, the transparent toner image 13, the color toner images 12 and the medium 11 are collectively released from the fixing belt 41 due to the curvature of the release roll 45 (releasing step).

In this manner, a highly glossy color image is formed on the medium 11.

In the image-creating process, corona discharge treatment (surface modification) makes the following operation.

That is, for example, a tentative standard of corona discharge treatment (surface modification) is on the assumption that the surface of the medium 11 is modified so that the ratio of surface resistance A before the surface modification to surface resistance B after the surface modification as shown in FIG. 4B is in a range of from $10^2$ to $10^5$.

On this occasion, the surface resistance is measured, for example, with a digital ultra-high resistance meter "R8340A" made by ADVANTEST CORPORATION, in the condition that a voltage of 100 V is applied to a sample set in an ultra-high resistance measuring sample box "TR42" made by ADVANTEST CORPORATION.

As another standard of corona discharge treatment (surface modification), the surface of the medium 11 may be modified so that the contact angle for water before the surface modification is reduced by a value of 20 degrees to 50 degrees after the surface modification.

On this occasion, the contact angle for water is measured, for example, with a CA-A type contact angle meter made by KYOWA INTERFACE SCIENCE CO., LTD., by a liquid-drop method. Distilled water is used as a standard liquid. The contact angle for water is measured 10 times under the condition of 22° C. and the measured values are averaged.

According to a further aspect, the surface of the medium 11 may be modified so that the superficial oxygen content of the medium 11 is in a range of from 10% to 20%, both inclusively, after the surface modification.

On this occasions as a method for measuring the surface oxygen content after the surface modification, the surface of the medium 11 is analyzed by an ESCA850 model made by SHIMADZU CORPORATION. X-rays are generated with Mg used as an anticathode under the condition of a voltage of 8 kV and a current of 30 mA, so that measurement is made under a vacuum of $10^{-6}$ Pa or lower. $C_{1s}$ and $O_{1s}$ are analyzed as targets by wide-range scanning, so that $O_{1s}/(C_{1s}+O_{1s})$ is used as the surface oxygen content.

If any one of the aforementioned requirements is satisfied, both transferability and fixability can be kept good because the surface of the medium 11 can be activated sufficiently by the corona discharge treatment.

Such performance can be backed up with the following Examples.

In the image-creating process, the medium 11 and the fixing belt 41 are preferably selected so that evaluated values of the following optical reflection characteristics (1) to (3) of the surface of the created image are in desired ranges respectively. Incidentally, a system for evaluating the optical reflection characteristics of an image has been already disclosed, for example, in Japanese Patent Application No. 2002-164872.

(1) Calculation of Half-Value Width

The maximum value Rmax of reflectance is obtained on the basis of an X-direction reflection distribution in each Y position. When A(Y) is the absolute value of a difference between two X values of reflectance equal to a half of the maximum value, A is calculated by the following equation.

$$\text{Average Half-Value Width: } A=\Sigma A(i)/n$$

On the other hand, in the condition that a gloss measuring standard plate (black, gloss 96.8) made by MURAKAMI COLOR RESEARCH LABORATORY in place of the evaluation image is placed on the image fixing table, A0 is obtained in the same measurement/calculation manner as described above.

If A/A0 is smaller than unity, preferable surface appearance cannot be obtained because the image is curved so that the front surface becomes a concave surface. If A/A0 is larger than 2, a preferable appearance of the image surface is not given because the surface is spoiled in terms of smoothness.

(2) Calculation of Appearance of Center-of-Gravity Variation $\Delta X_G WS$

The value of the characteristic (2) is an index corresponding to appearance of waviness of the reflected image and calculated as follows.

First, the X coordinate $X_G(y)$ of the center of gravity in each Y position is calculated by the following equation:

$$X_G(y)=\Sigma\{j\cdot R(j,y)\}/\Sigma R(j,y)$$

in which R(j,y) is the reflectance value in the case of X=j and Y=y.

Appearance of center-of-gravity variation $\Delta X_G WS$ is calculated by the following equations:

$$\Delta X_G(u)=\int \Delta X_G(y)\cdot e^{-2}n^{1Dy}dy$$

$$\Delta X_G WS=\int \Delta X_G(u)\cdot VTF(u)du$$

in which VTF(u) is calculated by the following equations:

$$VTF(u)=5.05\cdot e^{-0.843u}\cdot(1-e^{-0.611u}) \text{ in the case of } u\geqq 0.78, \text{ and}$$

$$VTF(u)=1.00 \text{ in the case of } u<0.78.$$

On the other hand, in the condition that a gloss measuring standard plate (black, gloss 96.8) made by MURAKAMI COLOR RESEARCH LABORATORY in place of the evaluation image is placed on the image fixing table, appearance of center-of-gravity variation $\Delta X_G WS$0 is obtained in the same measurement/calculation manner as described above.

If $\Delta X_G WS/\Delta X_G WS$0 is larger than 10, an image having a preferable surface appearance cannot be obtained because waviness of reflected image is conspicuous.

(3) Calculation of One-Tenth Value Width

The maximum value Rmax of reflectance is obtained on the basis of an X-direction reflectance distribution in each Y position. When B(Y) is the absolute value of a difference between two X values of reflectance equal to one tenth of the maximum value, B is calculated by the following equation.

$$\text{Average One-Tenth Value Width: } B=\Sigma B(i)/n$$

If B is smaller than 3×A0, the image presents an undesirable appearance because the curvature or crease of the image is apt to be conspicuous as well as a defect or dirt on the image surface is apt to be conspicuous. If B is larger than 6×A0, the image is inferior in color reproduction and high-density reproduction as well as a preferable appearance of the image surface is not given because the image surface is not smooth and looks hazy.

For example, as for the requirement (1), if A/A0 is larger than 2, it is preferable that the surface roughness of the fixing belt 41 is reduced.

On the other hand, if A/A0 is smaller than unity, it is preferable that the thickness of the medium 11 is increased or a thermoplastic resin layer is provided on the rear surface of the medium 11.

As for the requirement (2), if $\Delta X_G WS/\Delta X_G WS$0 is larger than 10, it is preferable that raw paper of a high smoothness and of a uniform structure in formation is used or it is preferable that a rubber layer is made harder or thinner when the rubber layer is provided on the surface of the fixing belt 41.

Further, as for the requirement (3), if B/B0 is smaller than 3, it is preferable that a fixing belt 41 having a rubber layer containing fillers or fine particles, both made of inorganic or organic materials as additives in its surface is used.

If B/B0 is larger than 6, it is preferable that a fixing belt 41 of smooth surface is used or it is preferable that the size of filler or fine particles is reduced when a belt having a rubber layer containing fillers or fine particles as additives in its surface is used.

More specifically, with respect to the surface of the fixing belt 41, it is preferable that the fixing belt 41 is selected to satisfy the optical characteristics (1) and (3).

In this case, when the melting characteristic of the transparent toner constituting the surface of the image is selected to be in a preferable range, the surface shape of the fixing belt 41 is directly transferred onto the image on the medium 11.

The preferable melting characteristic of the transparent toner can be obtained when the viscosity of the toner resin is in a range of from $10^2$ Pa·s to $5\times10^3$ Pa·s at the temperature of the toner layer in the fixing step.

If the viscosity is lower than $10^2$ pa·s, there is a problem in offset of the transparent toner image (the transparent toner having a tendency to remain on the fixing belt 41). If the viscosity is higher than $5\times10^3$ Pa·s, the particle shape of the transparent toner remains in the surface of the image to make it difficult to satisfy the requirement (3).

Incidentally, in this embodiment, the viscosity is measured, for example, with a rotary flat plate type of rheometer (RDAII made by RHEOMETRIC SCIENTIFIC INC,) under the condition of a distortion rate of 20% and an angular velocity of 1 rad/sec.

Further, a factor contributing to the requirement (2) is the elasticity of the fixing belt 41 and the medium 11.

The preferable hardness characteristic of the fixing belt 41 can be obtained when the fixing belt 41 has an elastic layer having a hardness (Asker C) of 30 degrees to 60 degrees and a thickness of 20 μm to 50 μm.

If the hardness is too low or the elastic layer is too thick, the requirement (2) cannot be satisfied in accordance with the toners and the medium 11.

On the other hand, if the hardness is too high or the elastic layer is too thin, a uniform surface cannot be obtained because a boundary between a high density area and a low density area hardly adheres to the fixing belt 41.

The preferable elasticity characteristic of the medium 11 can be also obtained when the fraction of voids in a paper portion of the medium 11 except the surface layer is not lower than 50%.

Incidentally, in this embodiment, the fraction of voids is measured with a porosimeter (made by SHIMADZU CORPORATION) using mercury porosimetry.

Embodiment 2

Embodiment 2 of the color image-forming system according to the invention will be described below.

Figure 6:
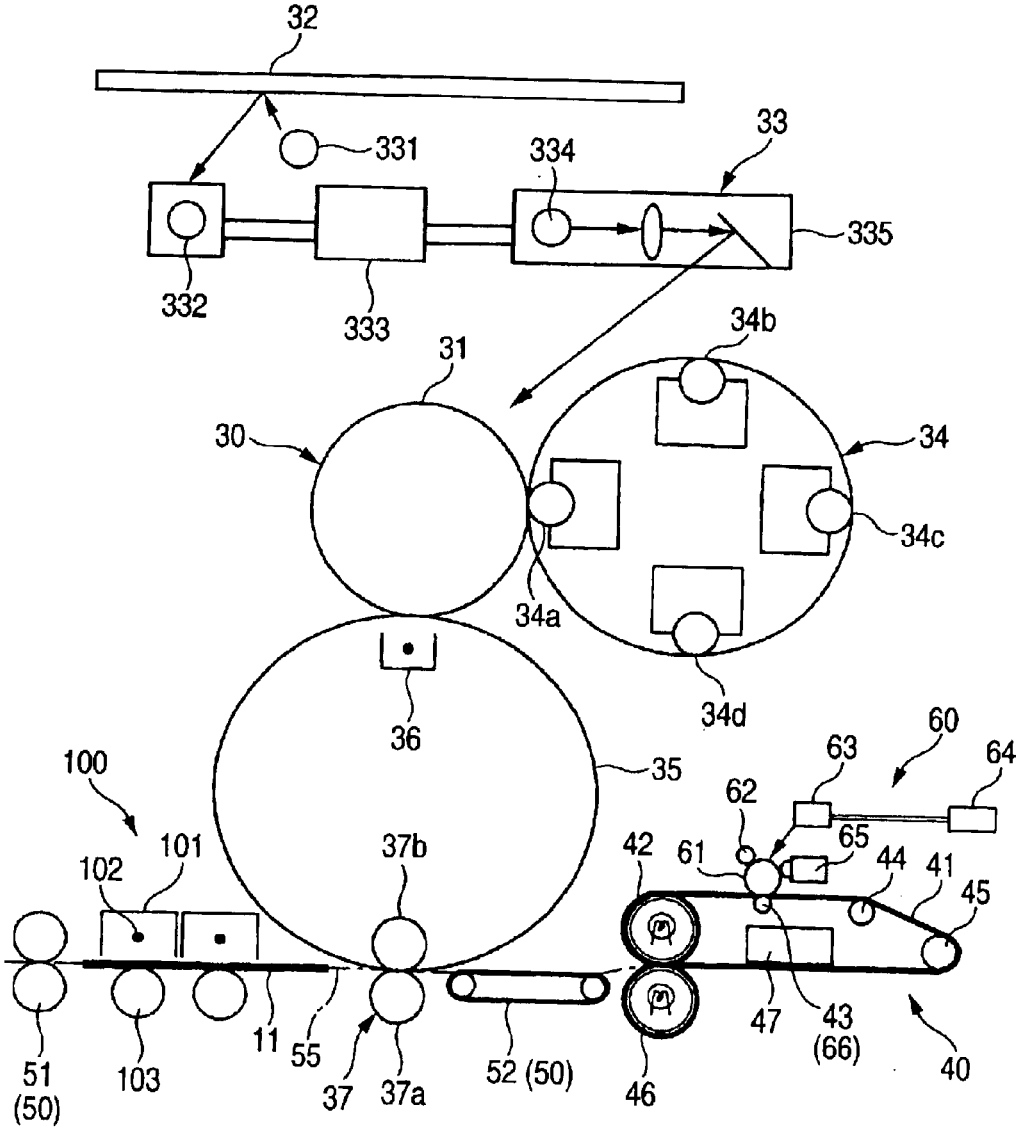
FIG. 6 is an explanatory view showing Embodiment 2 of the image-forming system according to the invention.

For example, as shown in FIG. 6, the color image-forming system according to this embodiment has: an image-creating unit 30 for forming a photographic image (see FIGS. 3A to 3C) which includes a combination of a color toner image 12 and a transparent toner image 13 on a medium 11 at least having a diffuse reflection layer at least containing white pigments and thermoplastic resins; a fixing unit 40 for fixing the respective toner layers formed on the medium 11 by the image-creating unit 30; a conveyor unit 50 for conveying the medium 11 having the image formed thereon to the fixing unit 40; and a surface modification unit 100 placed along the upstream side of an image-forming region of the image-creating unit 30 in a medium conveyance path 55. This embodiment is different from Embodiment 1 in that a transparent toner image-forming unit 60 for forming a transparent toner image on the belt-like fixing member (fixing belt 41) of the fixing unit 40 is provided in place of the transparent toner development unit 34*e* of the rotary development unit 34 in the image-creating unit 30.

The basic configurations of the image-creating unit 30, the fixing unit 40, the conveyor unit 50 and the surface modification unit 100 in this embodiment are substantially equivalent to those in Embodiment 1. In Embodiment 2, constituent parts the same as those in Embodiment 1 are referred to by the same numerals as those in Embodiment 1, so that detailed description thereof will be omitted.

Particularly in this embodiment, the transparent toner image-forming unit 60 has a transparent toner image carrier 61 (which may be shaped like a drum or a belt), and respective devices for forming a transparent toner image on the transparent toner image carrier 61.

In this embodiment, a polymer film such as a polyimide film can be used as the transparent toner image carrier 61. Preferably, electrically conductive additives such as electrically conductive carbon particles or an electrically conductive polymer may be dispersed into the polymer film to adjust the resistance value of the polymer film in order to stably form a transparent toner image of constant mass density. The transparent toner image carrier 61 may be shaped like a sheet or may be preferably shaped like an endless belt. It is also preferable from the point of view of releasability that a surface of the belt is coated with a silicone resin and/or a fluororesin. It is further preferable from the point of view of smoothness that the surface gloss measured with a 75° gloss meter is not lower than 60.

The devices for forming the transparent toner image may be selected suitably. Development units known in themselves can be used as the devices.

For example, in a position where a roll grounded or supplied with a bias voltage comes into contact with the rear surface of the transparent toner image carrier 61, a transparent toner layer may be directly developed on the transparent toner image carrier 61 by a one-component development unit or a two-component development unit opposite to the transparent toner image carrier 61.

In this case, it is preferable that the temperature of the transparent toner image carrier 61 in the position of the transparent toner development unit is not higher than 60° C.

When electrophotography is used in the transparent toner image-forming unit 60, it is preferable that, for example, a photoconductor drum is used as the transparent toner image carrier 61 and that the transparent toner image-forming unit 60 has a charger 62 disposed opposite to the photoconductor drum 61, an exposure unit 63 for exposing the photoconductor drum 61, a signal-generating unit 64 for controlling a transparent toner image-forming area on the medium 11 on which color toner images are transferred, a transparent toner image development unit 65 disposed opposite to the photoconductor drum 61, and a transfer unit 66 for transferring the transparent toner image formed on the photoconductor drum 61 onto the belt-like fixing member (fixing belt) 41.

The photoconductor drum 61 is not particularly limited and a known photoconductor drum may be used as the photoconductor drum 61. The photoconductor drum 61 may be of a monolayer structure or may be of a separated function type of multilayer structure. The material of the photoconductor drum 61 may be an inorganic material such as selenium or amorphous silicon or may be an organic material.

A unit known in itself, such as a contact charger using an electrically conductive or semiconductive roll, brush, film or rubber blade, or a corotron or corotron charger using corona discharge, can be used as the charger 62.

A laser scanning system (ROS: Raster Output Scanner) having a semiconductor laser, a scanning unit and an optical system may be used as the exposure unit 63, or any other known light source such as an LED head or a halogen lamp may be used as the exposure unit 63.

In this embodiment, the exposure unit 63 is provided with the signal-generating unit 64. In consideration of a preferred embodiment in which the area of an image to be exposed, that is, the position of the medium 11 to be coated with the transparent toner image is changed to a required area on the basis of the signal created by signal-generating unit 64, a laser scanning system or an LED head may be preferably used as the exposure unit 63.

Any known development unit can be used as the transparent toner image development unit 65 regardless of whether the development unit is a one-component development unit or a two-component development unit if the development unit can achieve the purpose of forming a transparent toner layer of uniform mass density on the photoconductor drum 61. Although this embodiment has shown the case where the area of formation of the transparent toner image 13 is controlled on the basis of the signal issued from the signal-generating unit 64, the invention may be also applied to the case where the transparent toner image 13 is formed particularly on the whole surface of the medium 11.

A known method can be used in the transfer unit 66. For example, there may be used a method in which an electrically conductive or semiconductive roll, brush, film or rubber blade supplied with a voltage is used for generating electric field between the photoconductor drum 61 and the fixing belt 41 to thereby transfer charged transparent toner particles, or a method in which a corotron or corotron charger using corona discharge is used for corona-charging the rear surface of the fixing belt 41 to thereby transfer charged transparent toner particles. Incidentally, FIG. 6 shows the case where the set roll 43 is used as a functional member of the transfer unit 66.

Next, the operation of the image-forming system according to this embodiment will be described.

As shown in FIG. 6, when the image-forming system according to this embodiment is to be used for making a color copy, the original 32 as a subject of copying is first irradiated with light emitted from the illumination lamp 331. The light reflected from the original 32 is scanned and separated into colors by the color scanner 332. The colors are image-processed and corrected by the image processing unit 333 to thereby obtain a plurality of image data for the color toner images. Each image data is modulated by the laser driver (not shown) to thereby generate modulated laser beams emitted by the laser diode 334.

The photoconductor drum 31 is irradiated with the laser beams color by color by a plurality of times to thereby form a plurality of electrostatic latent images. The plurality of electrostatic latent images are successively developed by the yellow development unit 34*a*, the magenta development unit 34*b*, the cyan development unit 34*c* and the black development unit 34*d* using four color toners of yellow, magenta, cyan and black respectively.

The developed color toner images on the photoconductor drum 31 are successively transferred onto the intermediate transfer belt 35 by the primary transfer unit 36 (transfer corotron). The four color toner images transferred onto the intermediate transfer belt 35 are collectively transferred onto the medium 11 by the secondary transfer unit 37.

On the other hand, the corona discharge treatment unit 100, which serves as the surface modification unit, applies corona discharge treatment to a surface of the medium 11 to activate the surface of the medium 11.

In this manner, when the activated medium 11 reaches the image-forming region of the image-creating unit 30, the respective toner images on the intermediate transfer belt 35 can be surely transferred onto the medium 11 with sufficient transfer efficiency.

Figure 7:
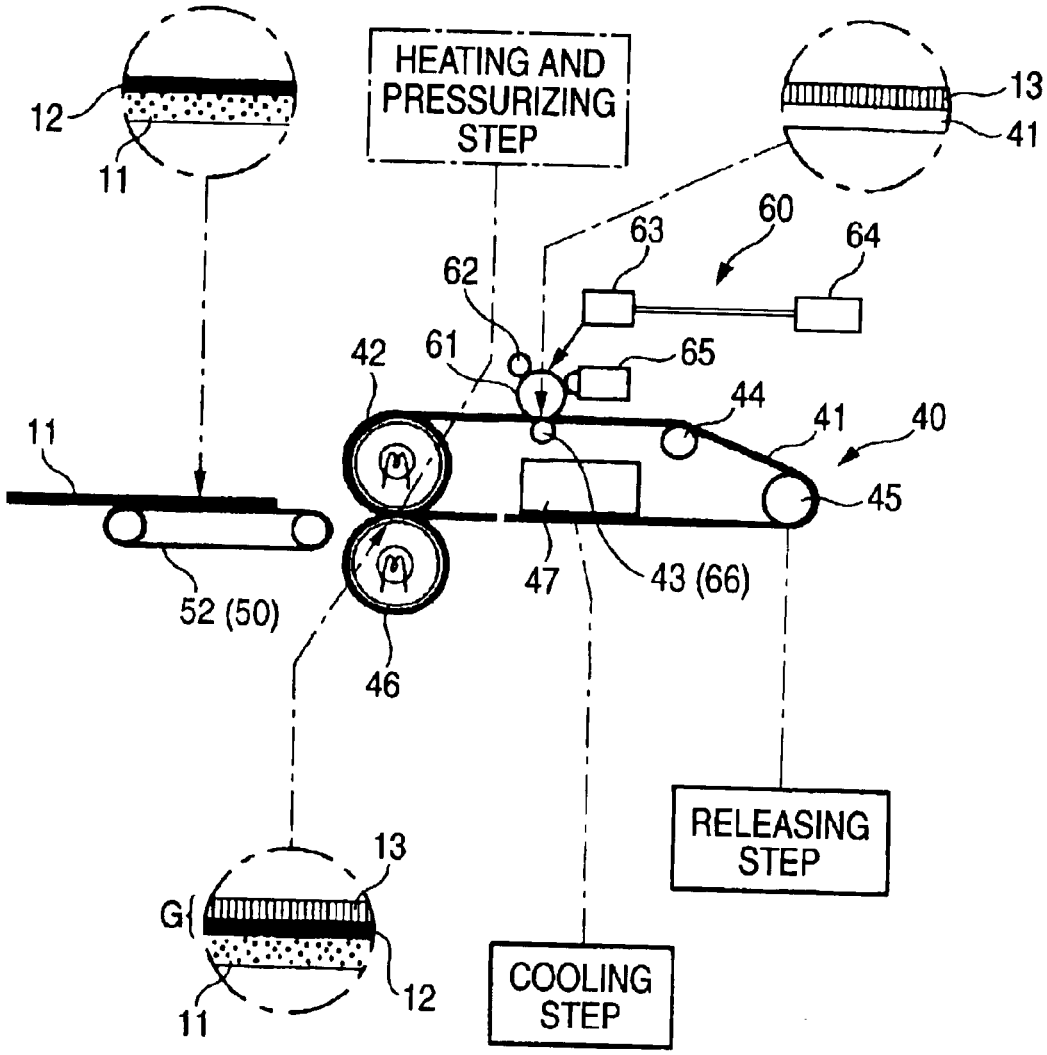
FIG. 7 is an explanatory view showing an image fixing step in Embodiment 2.

As shown in FIG. 7, the medium 11 having the color toner images formed thereon in this manner is conveyed into the fixing unit 40 via the conveyance belt 52.

Next, the operations of the fixing unit 40 and the transparent toner image-forming unit 60 will be described.

Both the heat roll 42 and the pressure roll 46 are heated to a toner melting temperature in advance. For example, a load of 100 kg weight is applied between the two rolls 42 and 46. The two rolls 42 and 46 are further driven to rotate, so that the fixing belt 41 is driven following the two rolls 42 and 46.

The photoconductor drum 61, which serves as the transparent toner image carrier of the transparent toner image-forming unit 60, rotates in sync with the conveyance of the medium 11. A bias voltage is applied to the charger (e.g., charge roll) 62, so that the photoconductor drum 61 is electrically charged uniformly. The photoconductor drum 61 is exposed by the exposure unit 63 on the basis of the image signal created by the signal-generating unit 64.

In this case, the potential of the exposed area is reduced, so that this area is developed by the transparent toner image development unit 65. Then, as shown in FIG. 7, the transparent toner image 13 on the photoconductor drum 61 is transferred onto the fixing belt 41 by the transfer unit (transfer roll) 66 supplied with a bias voltage.

Then, the fixing belt 41 having the transparent toner image 13 transferred thereonto and the medium 11 having the color toner images 12 formed thereon come into contact with each other in a nip portion between the heat roll 42 and the pressure roll 46, so that the color toner images 12 and the transparent toner image 13 are heated and melted (heating and pressurizing step).

Then, the medium 11 and the fixing belt 41 are carried to the release roll 45 while the medium 11 and the fixing belt 41 are clung together through the melted toner images. During the conveyance, the fixing belt 41, the transparent toner image 13, the color toner images 12 and the medium 11 are cooled by the heat sink 47 (cooling step).

Accordingly, when the medium 11 reaches the release roll 45, the transparent toner image 13, the color toner images 12 and the medium 11 are collectively released from the fixing belt 41 due to the curvature of the release roll 45 (releasing step).

In this manner, a highly glossy color image is formed on the medium 11.

Embodiment 3

Embodiment 3 of the color image-forming system according to the invention will be described below.

Figure 8:
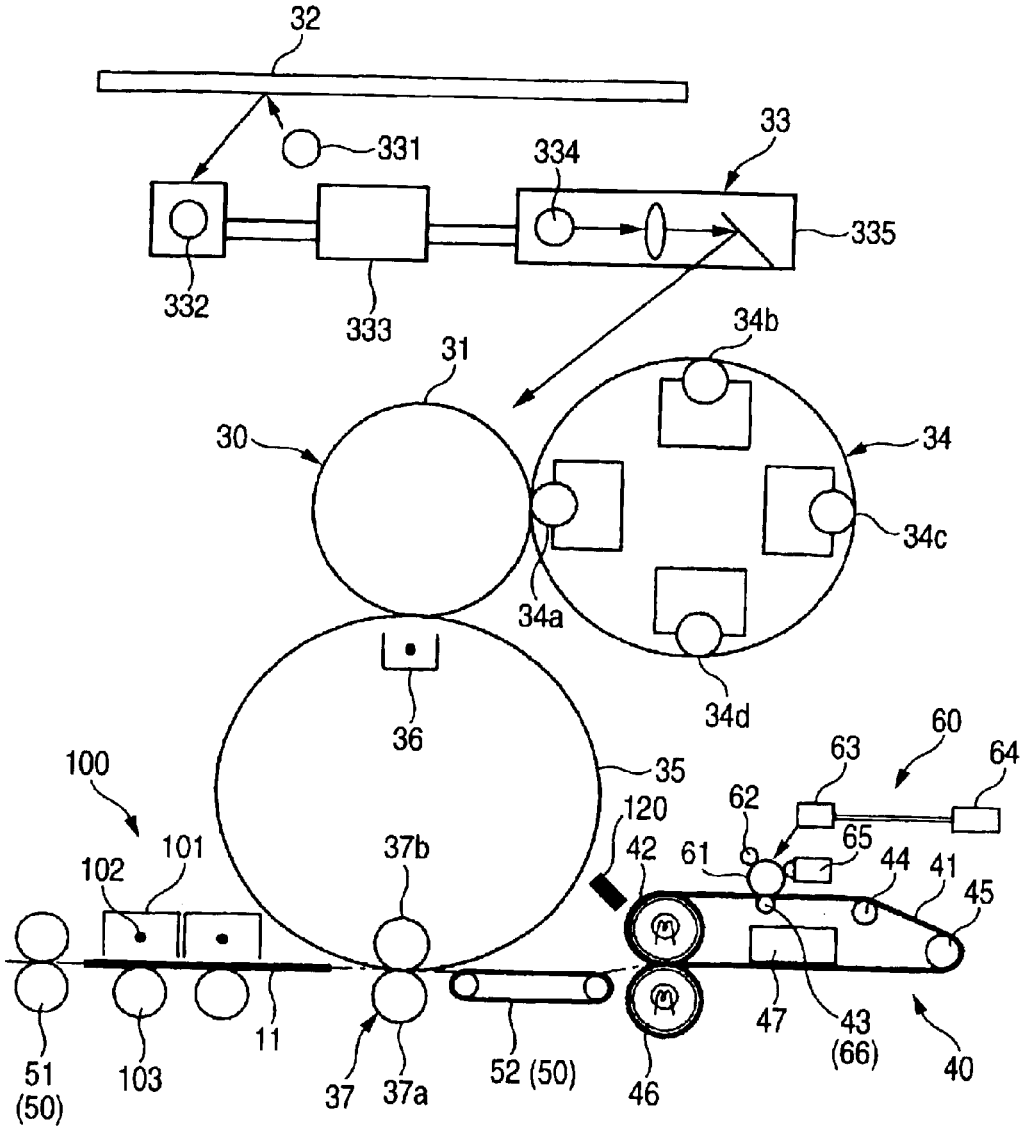
FIG. 8 is an explanatory view showing Embodiment 3 of the image-forming system according to the invention.

As shown in FIG. 8, the basic configuration of the color image-forming system according to this embodiment is substantially the same as in Embodiment 2 except that an auxiliary surface modification unit 120 is disposed opposite to a region of the fixing belt 41 located between the image-forming region of the transparent toner image-forming unit 60 and the nip portion between the heat roll 42 and the pressure roll 46. Incidentally, in Embodiment 3, constituent parts the same as those in Embodiment 2 are referred to by the same numerals as those in Embodiment 2, so that detailed description thereof will be omitted.

A device the same as the surface modification unit 100 can be used as the auxiliary surface modification unit 120. For example, a corona discharge treatment unit may be used as the auxiliary surface modification unit 120.

The auxiliary surface modification unit 120 is provided for applying corona discharge treatment to the surface of the transparent toner image formed on the fixing belt 41 to thereby activate the surface of the transparent toner image. This embodiment is formed so that the adhesion of the transparent toner image and the color toner image to each other can be made higher compared with Embodiment 2.

EXAMPLES

Example 1

Color Toner Developers

A cyan developer, a magenta developer, a yellow developer and a black developer for DocuCentre Color 500 made by FUJI XEROX CO., LTD. were used as color toner developers. A main component of thermoplastic resin for the color toners is a styrene-acrylic copolymer as a main component.

Transparent Toner

Linear polyester (molar ratio=5:4:1, Tg=62° C., Mn=4500, Mw=10,000) obtained from terephthalic acid/bisphenol A ethylene oxide adduct/cyclohexanedimethanol was used as a binder resin. The binder resin was pulverized by a jet mill and then classified by a wind power type classifier to thereby produce transparent fine particles of $d_{50}$=11 $\mu$m. The following two kinds of inorganic fine particles A and B were deposited on 100 parts by weight of the transparent fine particles by a high-speed mixing machine.

The inorganic fine particles A were made of $SiO_2$ (surface-treated with a silane coupling agent to be made hydrophobic and having a mean particle size of 0.05 $\mu$m). The amount of the inorganic fine particles A added was 1.0 part by weight. The inorganic fine particles B were made of $TiO_2$ (surface-treated with a silane coupling agent to be made hydrophobic and having a mean particle size of 0.02 $\mu$m and a refractive index of 2.5). The amount of the inorganic fine particles B added was 1.0 part by weight.

The toner was mixed with the same carrier as that for the black developer serving as one of the color toners to thereby produce a two-component developer.

Color Image-Forming System (Image-Creating Unit)

A model (color image-forming system shown in FIG. 2) according to Embodiment 1 was used as an image-forming system. The speed of the image-forming process except the fixing step was 160 mm/sec. A constant voltage of 3 kV was applied to the secondary transfer roll. The toner/carrier weight ratio, the potential of the charged photoconductor, the exposure intensity and the development bias voltage were adjusted so that the weight density of the developed color toner for each color became 0.5 mg/cm$^2$ in the area where the level of the image signal is set at 100%.

Transparent Toner Development

A two-component development unit is used in the transparent toner image development unit 65. The toner/carrier weight ratio, the potential of the charged photoconductor, the exposure intensity and the developing bias voltage were adjusted so that the weight density of the developed transparent toner became 1.5 mg/cm$^2$.

Medium

Peachcoat paper (PET medium containing a white pigment dispersed therein, 110 gsm, made by NISSHINBO INDUSTRIES, INC.) was used as the medium 11 used for forming a color image.

Corona Discharge Treatment

As shown in FIG. 2, two corotron dischargers arranged were used as a corona discharge treatment unit.

The metal shield 101 was made of stainless steel.

The discharge wire 102 was made of gold-plated tungsten with a diameter of 30 μm. The distance between the discharge wire 102 and a surface of the medium 11 was adjusted to be 2 mm.

The metal shield 101 was electrically floated. The voltage applied to the discharge wire 102 was adjusted to be AC 10 kV. The DC component was adjusted so that the surface potential of the medium 11 was within a range of ±50 V after the corona discharge treatment was completed.

Fixing Unit

An 80 μm-thick polyamide film containing electrically conductive carbon dispersed therein was coated with 50 μm-thick KE4895 silicone rubber (made by SHIN-ETSU CHEMICAL CO., LTD.). This resulting film was used as the fixing belt 41.

Two rolls each having an aluminum core, and a 2 mm-thick silicone rubber layer provided on the aluminum core were used as the heat roll 42 and the pressure roll 46 respectively. A halogen lamp was disposed as a heat source in the middle between the two rolls 42 and 46. The surface temperature of each of the rolls 42 and 46 was adjusted to be 175° C.

The fixing speed was set at 30 mm/sec.

The temperature of the medium in the release position was 70° C.

The toner materials herein used were evaluated as follows.

Molecular weight was measured by gel permeation chromatography. Tetrahydrofuran was used as a solvent.

Example 2

A color image was produced in the same manner as in Example 1 except that the image-forming system was replaced by a model (shown in FIG. 5) according to Embodiment 2.

Example 3

A color image was produced in the same manner as in Example 1 except that the medium used for creating the color image was replaced by a medium produced by the following procedure.

Method for Producing Medium

A 30 μm-thick diffuse reflection layer made of a mixture of 100 parts by weight of a polyethylene resin and 30 parts by weight of titanium oxide was laminated on the front surface of a 150 μm-thick raw paper sheet made of a pulp material. A 30 μm-thick polyethylene resin was laminated on the rear surface of the raw paper sheet. Colloidal silica was further coated as an antistatic agent on the polyethylene resin of the rear surface.

Example 4

A color image was produced in the same manner as in Example 1 except that the color toners were replaced by the following color toners.

Color Toner Developers

The color toner developers used in the following examples were a cyan developer, a magenta developer, a yellow developer and a black developer for A color 935 made by FUJI XEROX CO., LTD. A thermoplastic resin contained a polyester resin as a main component.

Example 5

A color image was produced in the same manner as in Example 3 except that the transparent toner layer was not provided.

Example 6

A color image was produced in the same manner as in Example 1 except that the corona discharge treatment unit and condition were replaced by the following unit and condition.

A Φ20 mm roll having a Φ10 mm stainless steel core and a 5 mm-thick electrically conductive rubber layer formed around the stainless steel core was used as the corona discharge treatment unit. An AC voltage of 10 kV was applied to the core of the roll so that the Φ20 mm metal roll was rotated at a constant circumferential speed equal to the velocity of the medium 11 while the Φ20 mm metal roll came into contact with the medium 11 in the condition that the Φ20 mm metal roll was sandwiched between grounded opposite electrodes.

Example 7

A color image was produced in the same manner as in Example 6 except that the image-forming system was replaced by a model (color image-forming system shown in FIG. 8) according to Embodiment 3 while the same medium 11 as in Example 3 was used.

Comparative Example 1

A color image was produced by the same system as in Example 3 except that the corona discharge treatment unit was not provided.

Comparative Example 2

A color image was produced by the same system as in Comparative Example 1 except that the transfer voltage was set at 5 kV.

Comparative Example 3

A color image was produced by the same system as in Example 5 except that the corona discharge treatment unit was not provided.

The surface modification effect of each of Examples 1 to 7 was examined. Results of the examination were as shown in FIG. 9.

In FIG. 9, surface resistance values before and after surface modification, the change ratio of surface resistance before treatment to surface resistance after treatment and contact angles before and after surface modification were measured in each of Examples 1 to 7 and the surface oxygen content was further measured in each of Examples 3, 5 and 7.

The image obtained in each of Examples and Comparative Examples was evaluated by the following evaluation method.

(Evaluation of Graininess)

Each gray image having a size of 5 cm×5 cm was produced in the condition that all the levels of input image signals of cyan, magenta and yellow were set to be 50% constantly. The gray image was visually evaluated by twenty persons so as to be rated into the following five grades in terms of graininess.

1: very poor

2: poor

3: neither good nor poor
4: good
5: very good

Then, the obtained average of the graded values was evaluated according to the following criteria.

X: the case where the average was smaller than 2.0

Δ: the case where the average was not smaller than 2.0 but smaller than 3.5

○: the case where the average was not smaller than 3.5

(Evaluation of Mottle)

Each solid black image having a size of 5 cm×5 cm was produced in the condition that all the levels of input image signals of cyan, magenta and yellow were set to be 100% constantly. The solid black image was evaluated in accordance with eye observation by twenty persons so as to be classified into the following five grades by the degree of mottling (density unevenness of low spatial frequency).

1: very poor
2: poor
3: neither good nor poor
4: good
5: very good

Then, the obtained average of the graded values was evaluated according to the following criteria.

X: the case where the average was smaller than 2.0

Δ: the case where the average was not smaller than 2.0 but smaller than 3.5

○: the case where the average was not smaller than 3.5

(Evaluation of Total Image Quality)

An image copied from a portrait photograph as an original was used for subjective evaluation of overall image quality. The image which was illuminated by a desktop fluorescent lamp, was evaluated by twenty persons so as to be classified into the following five grades.

1: very poor
2: poor
3: neither good nor poor
4: good
5: very good

Then, the obtained average of the graded values was evaluated according to the following criteria.

X: the case where the average was smaller than 2.0

Δ: the case where the average was not smaller than 2.0 but smaller than 3.5

○: the case where the average was not smaller than 3.5

(Evaluation of Transfer Efficiency)

A solid black image formed in the same manner as in Evaluation of Mottle was used. The weight of toner transferred onto the medium and the weight of the toner image on the intermediate transfer belt before secondary transfer were measured. Transfer efficiency was calculated according to the following equation.

Transfer Efficiency=(weight of toner transferred onto the medium)/(weight of the toner on the intermediate transfer belt before secondary transfer)

The transfer efficiency was evaluated according to the following criteria.

X: the case where the transfer efficiency was smaller than 0.85

Δ: the case where the transfer efficiency was not smaller than 0.85 but smaller than 0.95

○: the case where the transfer efficiency was not smaller than 0.95

For comparison in retention of the intermediate transfer belt, the transfer efficiency was evaluated in the same manner as described above after 1,000 portrait images were printed.

(Evaluation of Fixation)

Fixation of the toner image on the medium 11 was evaluated according to the following method.

A solid black image was produced in the same manner as the image used for evaluation of mottle. An adhesive tape (Scotch Mending Tape #810 made by 3M COMPANY) was attached on an edge of the solid black image so that an adhesive surface of the pressure-sensitive adhesive tape faced downward. After a Φ80 mm roll of stainless steel was rolled on the adhesive tape, the adhesive tape was left for 10 minutes. Then, the tape was peeled from the white background portion.

In this operation, fixation was evaluated as follows.

XX: the case where the image was entirely peeled with the tape

X: the case where the image was partially peeled with the tape

○: the case where the image was not peeled

FIG. 10 shows results of the evaluation.

According to FIG. 10, graininess, mottle, overall image quality, transfer efficiency (initial stage, after making 1,000 copies) and fixation in each of Examples 1 to 7 were evaluated as Δ or ○ whereas at least one of these evaluation items in each of Comparative Examples 1 to 3 was evaluated as X. It is understood that the image obtained in each of Examples 1 to 7 is rated highly.

According to the results of evaluation shown in FIG. 9, it is understood that the image quality is rated highly in accordance with the surface modification if the degree of the surface modification (corona discharge treatment) by the surface modification unit is in an appropriate range.

As described above, in accordance with the invention, a surface of a medium is activated by a surface modification unit before an image is formed on the medium by an image-creating unit. Hence, even in the case where the medium has a surface layer containing an electrically insulating thermoplastic resin as a main component, image transferability can be kept so good that an image having good granularity and a uniform density and preferable image quality can be surely obtained.

In addition, according to the invention, adhesion between the medium and the image can be kept good in the fixing step performed by the fixing unit even in the case where the medium has a surface layer containing an electrically insulating thermoplastic resin as a main component. Hence, an image good in fixation can be obtained.

What is claimed is:

1. An image-forming system, comprising:

an image-creating unit for forming an image on a medium, having an image-forming region;

a fixing unit for fixing the image formed by the image-creating unit on the medium;

a medium conveyance path extending to the image-forming region;

a surface modification unit for activating a surface of the medium, wherein the surface modification unit is placed along the medium conveyance path; and a surface modification controller connected to the surface modification unit, wherein the surface modification unit is adapted to selectively supply and hold a discharge voltage in accordance with an environmental condition.

2. The image-forming system according to claim 1, wherein the image includes color toner images or color toner images and a transparent toner image.

3. The image-forming system according to claim 2, wherein the fixing unit includes:

a fixing member which comes into close contact with a toner image on the medium so that the toner image is sandwiched between the fixing member and the medium, a heating and pressurizing unit for heating and pressurizing the toner image on the medium; and a cooling and releasing unit for cooling the heated and pressurized toner image and releasing the toner image from the fixing member.

4. The image-forming system according to claim 2, wherein when the image includes color toner images and a transparent toner image, the image-creating unit includes an electrostatic transfer unit for electrostatically transferring the color toner images and the transparent toner image onto the medium.

5. The image-forming system according to claim 2, wherein:

when the image includes color toner images and a transparent toner image, the image-creating unit includes:

an electrostatic transfer unit for electrostatically transferring the color toner images onto the medium, and a transparent toner image-forming unit for forming said transparent toner image on a fixing member of said fixing unit;

and the transparent toner image is superimposed on the color toner images on the medium by a nip portion of the fixing unit where the fixing member and the medium are nipped.

6. The image-forming system according to claim 5, further comprising:

an auxiliary surface modification unit provided between a transparent toner image-forming region of the fixing member and the nip portion of the medium for activating a surface of the transparent toner image.

7. The image-forming system according to claim 2, wherein a resin contained in each color toner is a styrene-acrylic copolymer.

8. The image-forming system according to claim 1, wherein the surface of the medium includes a layer containing an electrically insulating thermoplastic resin as a main component.

9. The image-forming system according to claim 8, wherein the medium at least includes a raw paper sheet made of a pulp material, and a diffuse reflection layer laminated on the raw paper sheet, the diffuse reflection layer containing at least a polyolefin thermoplastic resin, and titanium oxide particles as a white pigment dispersed into the polyolefin thermoplastic resin.

10. The image-forming system according to claim 8, wherein the medium at least includes a raw paper sheet made of a pulp material, a diffuse reflection layer coated on the raw paper sheet, and a gelatin layer further coated on the diffuse reflection layer, the diffuse reflection layer containing at least a polyolefin thermoplastic resin, and titanium oxide particles as a white pigment dispersed into the polyolefin thermoplastic resin.

11. The image-forming system according to claim 8, wherein the medium at least includes a raw paper sheet made of a pulp material, a diffuse reflection layer laminated on a front surface of the raw paper sheet, a polyethylene resin layer laminated on a rear surface of the raw paper sheet, and an antistatic layer further laminated on the polyethylene resin layer of rear surface, the diffuse reflection layer containing a polyolefin thermoplastic resin, and titanium oxide particles as a white pigment dispersed into the polyolefin thermoplastic resin.

12. The image-forming system according to claim 8, wherein the medium includes a diffuse reflection layer at least on its surface, the diffuse reflection layer containing a polyethylene terephthalate resin, and a white pigment dispersed into the polyethylene terephthalate resin.

13. The image-forming system according to claim 1, wherein the image-creating unit includes an electrostatic transfer unit for electrostatically transferring the formed image onto the medium.

14. The image-forming system according to claim 1, wherein the surface modification unit includes at least one corona discharge treatment unit.

15. The image-forming system according to claim 1, wherein the medium has a surface resistance of not lower than $10^{11}$ Ω before the medium is treated by the surface modification unit.

16. The image-forming system according to claim 1, wherein the medium surface has a contact angle with water of not smaller than 70 degrees before the medium is treated by the surface modification unit.

17. The image-forming system according to claim 1, wherein the surface modification unit modifies a surface of the medium so that a ratio of surface resistance before surface modification to surface resistance after surface modification is in a range of from $10^2$ to $10^5$.

18. The image-forming system according to claim 1, wherein the surface modification unit modifies a surface of the medium so that a contact angle with water after surface modification becomes smaller by a value of 20 degrees to 50 degrees than that before surface modification.

19. The image-forming system according to claim 1, wherein the surface modification unit modifies a surface of the medium so that a surface oxygen content of a surface layer of the medium after surface modification is in a range of from 10% to 20%, both inclusively.

* * * * *